United States Patent [19]

Martinez et al.

[11] 4,420,125

[45] Dec. 13, 1983

[54] COLLAPSIBLE REEL

[75] Inventors: Manuel Martinez, New Providence; Ronald P. Zelins, Rockaway, both of N.J.

[73] Assignee: Western Electric Company, Incorporated, New York, N.Y.

[21] Appl. No.: 290,280

[22] Filed: Aug. 6, 1981

[51] Int. Cl.[3] ..... B65H 75/02; B65H 75/24

[52] U.S. Cl. ..... 242/77; 242/110; 242/115

[58] Field of Search ..... 242/72, 110, 78.1, 78.7, 242/78.8, 81, 118.2, 77, 115

[56] References Cited

U.S. PATENT DOCUMENTS

| | | | |
|---|---|---|---|
| 299,041 | 5/1884 | Weeks | 242/110 |
| 464,234 | 12/1891 | Weeks | 242/110 |
| 1,832,590 | 11/1931 | Sponable | 242/110 X |
| 2,535,693 | 12/1950 | Murray | 242/72 |
| 2,625,342 | 1/1953 | Morgan | 242/110 X |

FOREIGN PATENT DOCUMENTS

| | | | |
|---|---|---|---|
| 56429 | 4/1936 | Norway | 242/110 |

*Primary Examiner*—Stuart S. Levy
*Assistant Examiner*—Lloyd D. Doigan
*Attorney, Agent, or Firm*—R. F. Kip, Jr.

[57] ABSTRACT

A collapsible reel (9) includes a resilient band (10) in the form of a discontinuous annulus and having end separated portions (14, 15). Those portions are coupled through a link (21) which is pivotable at two pivotal connections (24, 25), disposed at opposite ends of the link and fixedly coupled respectively to those portions, such that the link is movable between two positions at which the effective circumference of the reel has, respectively, been expanded and contracted. Detent means (40, 41) is used to hold the link releasably in the position at which the reel is expanded. The reel may be collapsed by inward pulling of a handle (50).

8 Claims, 7 Drawing Figures

COLLAPSIBLE REEL

TECHNICAL FIELD

This invention relates to reels which are adapted to support thereon a coil of a coilable elongated product (as, for example but without restriction, optical fiber cable), and which are collapsible to decrease the effective circumference thereof so as to facilitate removal of the coil from the reel.

BACKGROUND OF THE INVENTION

Insofar as is known, very little development work has been done in the field of collapsible reels.

U.S. Pat. No. 1,832,590 issued Nov. 17, 1931 in the name of Earl I. Sponable et al. discloses a collapsible reel for movie film in which the reel is divided into two rigid semicircular segments pivotably connected at their bottoms and coupled together at their tops by mechanism comprising a pair of toggle members, each having one end thereof pivotably coupled to a respective one of said segments, the other end of each such member being pivotably coupled by a pin to the other toggle member. Radially outward movement of the pin acts through the toggle members to spread apart the tops of the reel segments, while radially inward pin movement draws those tops together. A spring is used to bias the pin to its radially outward position.

U.S. Pat. No. 2,074,217 issued Mar. 16, 1937 to T. Grover discloses a carrier for freshly spun threads of artificial silk in which the thread is wound on a plurality of parallel rods spaced around the insides of two spaced coaxial discs to form a circular array of such rods, the rods being slidably mounted at their ends by such discs to be radially movable in an out. The rods are biased radially outward from their inner side by a resilient spring curved into annular shape such that the two ends of the spring are adjacent. Those two ends are coupled together by mechanism comprising a toggle joint of a link and a central arm pivotally connected together, and each coupled through another pivotal connection at an end thereof to a respective one of those spring ends. The central arm is extended beyond its pivotal connection with the link to provide a handle which can be moved inward from a normal to an actuated position. When the handle is in normal position, the ends of the spring are fully spread apart to drive the mentioned rods radially outwards to the fullest. Radial inward movement of the handle to actuated position causes the ends of the spring to be drawn together to thereby permit the rods to move radially inward.

SUMMARY OF THE INVENTION

A collapsible reel according to the invention comprises resilient annular means having the form of a discontinuous annulus and having end portions separated by the discontinuity of such annulus. Expansion and contraction of the effective circumference is accomplished, not by toggle joint action, but in a manner as follows:

The end portions of such annular means are coupled together by link means included in such reel and comprising a relatively stiff link and pivot connections therefor disposed at opposite ends of the link and each fixedly coupled to that end and to a respective one of such end portions. The link is pivotable at those connections to thereby be movable between first and second positions thereof at which the effective circumference of the annulus has been relatively expanded and contracted, respectively, by oppositely directed link movements, both of which are productive in the course of the movement of angular and radial displacement between such end portions. Such reel also comprises link stabilizing means cooperable with such link means to be adapted upon movement of such link to its first position to maintain it at that position, absent application of a reel collapsing force, while, upon such application, terminating such maintaining to permit such link to move to its second position.

BRIEF DESCRIPTION OF THE DRAWINGS

For a better understanding of the invention, reference is made to the following description of a representative embodiment thereof, and to the accompanying drawings wherein.

DETAILED DESCRIPTION OF STRUCTURAL ASPECTS

Figure 1:
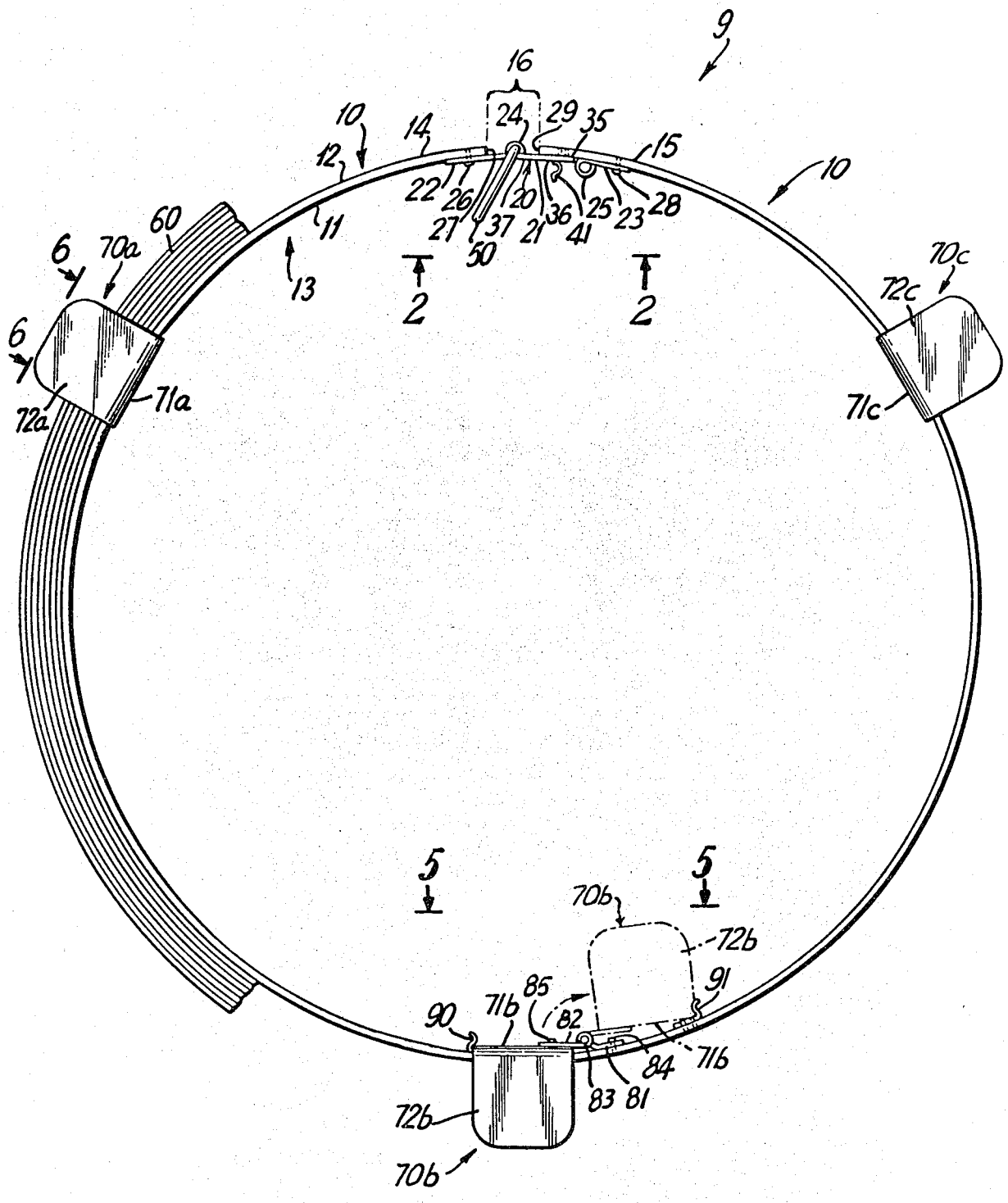
FIG. 1 is a front elevation of a reel according to the invention for mounting a coil thereon of a coilable elongated product, a portion of such coil being shown in such figure, and the reel being shown in its expanded configuration.

Referring to FIG. 1, the reference numeral 9 designates a reel of which part thereof is a resilient annular means in the specific form of a resilient band 10 having flat inner and outer surfaces 11 and 12 separated by the thickness of the band, the width of such band being substantially greater than such thickness. As shown, band 10 is curved in a plane transverse to its width to form discontinuous annulus 13 in which the end portions 14 and 15 of the band 10 are adjacent each other but are separated by the discontinuity 16 of the annulus. In the FIG. 1 embodiment, annulus 13 takes the form of a hoop. In terms of angular-radial coordinates, variation in the angular spacing of portions 14 and 15 will produce variation in the effective circumference of hoop 13. In its configuration shown in FIG. 1, hoop 13 is in its fully expanded position to have its maximum effective circumference. In the case of a reel in the form of a discontinuous annulus such as is disclosed herein, the effective circumference of the reel is considered to be the distance required to accommodate on the reel one full turn, wound on the surface of the reel, of a coilable elongated product.

For purposes of varying the effective circumference of the reel, the hoop end portions 14 and 15 are coupled together by link means 20 in the specific form in the FIG. 1 embodiment of a "Z" hinge. Such hinge comprises a center plate 21, end plates 22 and 23 at longitudinally opposite ends of such center plate and hinge pins 24 and 25 by which, respectively, plate 21 is fixedly coupled to plate 22 and plate 23. Center plate 21 constitutes a relatively stiff link between the pivot connections at the hinge pins 24 and 25, those connections being fixedly coupled to link 21 and being each fixedly coupled to a respective one of the end portions 14 and 15, such link being pivotable at each of those connections.

End plate 22 is fixedly secured by rivets 26, to hoop end portion 14 on the inside thereof, with part of the plate projecting outward of the termination 27 of that portion such that pin 24 is spaced around hoop 13 forward of that termination. End plate 23 is fixedly secured by rivets 28 to hoop end portion 15 on the inside thereof and rearward of the termination 29 of that portion such that pivot connection 25 is separated from that termination by a tab portion 35 of band 10. When hoop 13 is in its expanded configuration shown in FIG. 1, link 21 is in a position such that a portion 36 of link 21 overlaps and registers with tab portions 35 and is in substantially parallel alignment therewith. When the link is in such position, the part 37 of the link which does not overlap with such tab portion serves in relation to hoop end portion 15 as an extension thereof which is inserted into the effective circumference of hoop 13 to render it expanded.

Figure 2:
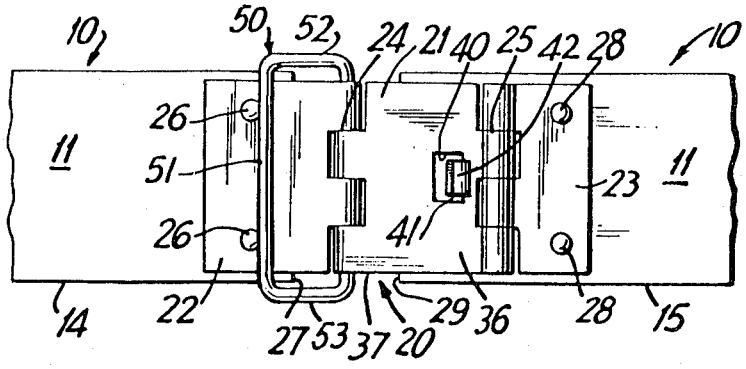
FIG. 2 is a bottom view, taken as indicated by the arrows 2—2 in FIG. 1, of a portion of the reel of FIG. 1.
Figure 3:
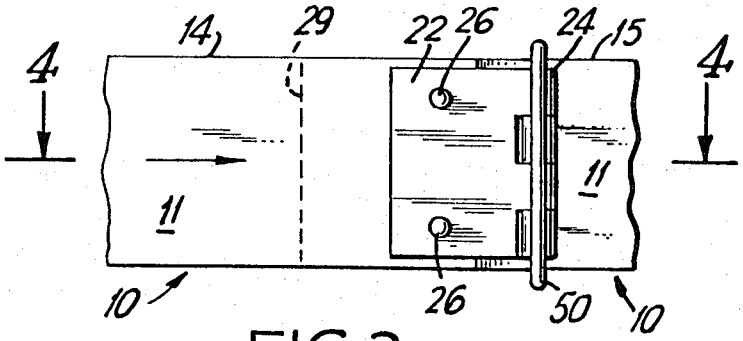
FIG. 3 is a view similar to that of FIG. 1 except that it is taken when the said reel is in a partly contracted configuration.
Figure 4:
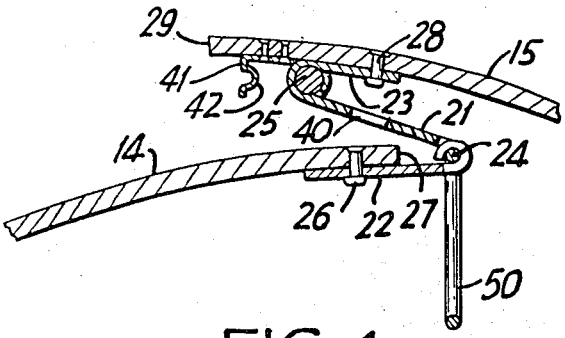
FIG. 4 is a front elevation in cross-section, taken as indicated by the arrows 4—4 in FIG. 3, of the portion of the reel shown in FIG. 3 when, as said, such reel is in a partly contracted configuration.

In the absence of a reel collapsing force, link 21 is maintained in the position just described by link stabilizing means cooperable with the mentioned link means to provide such maintaining. In the FIG. 1 reel, such link stabilizing means comprises detent means or more specifically, a latch means comprising an aperture 40 (FIGS. 2 and 4) formed in such link portion and a resilient latch finger 41 mounted on tab portion 35 on the inside thereof opposite aperture 40 to enter into and project through that aperture. Finger 41 is shaped to have towards its free end a lateral projection 42 which, when hoop 13 is in its FIG. 1 configuration overhangs, on the inner side of link 21, the edge of aperture 40 towards pin 25 to provide a detent engagement between such finger and a portion of such link bounding that aperture. such detect engagement may be with or without some play between projection 42 and such portion of such link.

The braking of such detent engagement may be effected by a handle means 50 coupled to hoop 13 and having its free end disposed on the inside of the hoop. In the FIG. 1 embodiment, handle 50 takes the specific form of a bail constituted of heavy wire or rod which is bent to provide (FIG. 2) a crossarm 51 at the free end of the handle and, also, a pair of sidearms 52, 53 extending from the opposite ends of such crossarm to the opposite ends of hinge pin 24 to be coupled at such opposite ends to such pin.

Figure 6:
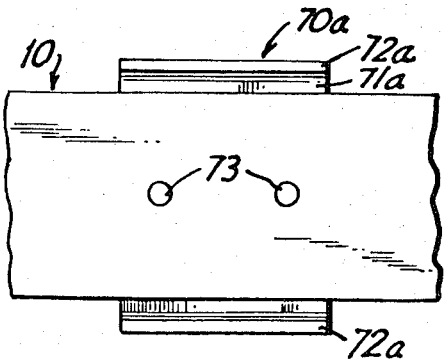
FIG. 6 is a view, taken as indicated by the arrows 6—6 in FIG. 1, of a portion of the said reel which includes a fixed coil retaining unit.

FIG. 1 shows part of a coil 60 of a coilable elongated product mounted on the outer or support surface 12 of the hoop 13. To prevent inadvertent lateral displacement of such coil off such surface when the hoop has its expanded configuration, the reel 9 is provided with a plurality of coil retaining means in the specific form in the FIG. 1 embodiment of "U"-shaped coil retainer units 70*a*, 70*b*, 70*c* disposed in spaced relation from each other along the band 10 and around the hoop. Unit 70*a* includes (FIG. 6) a flat base 71*a* disposed on the inside of, and secured to, band 10 and having opposite ends each disposed transversely outward of such band. Other elements of that unit are a pair of ears 72*a* projecting from such opposite ends radially outward of the base 71*a*. The unit 70*a* may be formed of a single stamping of sheet metal bent into the appropriate "U" shape.

Figure 5:
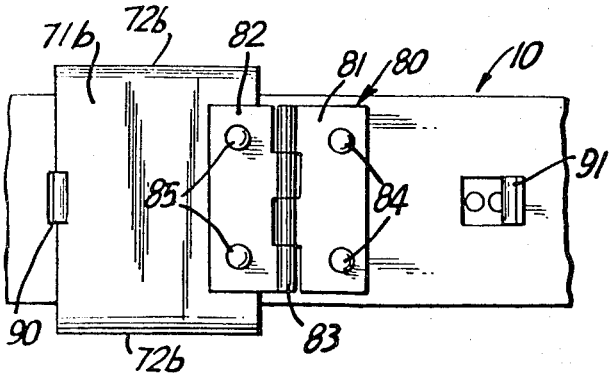
FIG. 5 is a view, taken as indicated by the arrows 5—5 in FIG. 1, of a portion of the reel which includes a movable coil retaining unit.

Units 70*b* and 70*c* are similarly contructed to unit 70*a* and are also secured to band 10. As a difference, however, units 70*a* and 70*c* are fixedly secured to such band by rivets 73 such that the ears 72 of such units project at all times radially outward of the outer or support surface 12 of band 10 to form stops for the coil 60 on such surface. In contrast, the retainer unit 70*b* (which is disposed around the hoop to be opposite the link means) is movably secured to band 10 in a manner as follows. A fastening means in the specific form of a hinge 80 (FIG. 5), consisting of plates 81, 82 and a hinge pin 83 joining them, has one of its plates 81 fixedly secured by rivets 84 to the inner surface of band 10. The other hinge plate 82 is fixedly secured by rivets 85 (or by other means such as fillet or spot welds) to one longitudinal side of the base 72*b* of the coil retainer unit 70*b*. Thus such unit is pivotable in relation to band 10 between a first position (shown in full lines in FIG. 1) at which the ears 72*b* project radially outward of band 10 (to retain a coil thereon) and a second position (shown in dot-dash lines in FIG. 1) at which base 71*b* has been flipped over and ears 72*b* have been moved to the inside of band 10 to no longer present any obstacle to the lateral displacement of coil 60 off the hoop 13. When in such first position, the unit 70*b* is releasably held in such position by a resilient latch finger 90 mounted on the inner surface 11 of band 10 and making a detent engagement with the longitudinal side of base 71*b* away from the hinge. After the unit 70 has been moved to its second position, it is releasably held in that position by a resilient latch finger 91 mounted on the inside of band 10 to make a detent engagement with the side first mentioned of base 71*b* when the base has been flipped over.

USE AND OPERATION

While a collapsible reel according to the invention is not restricted to use with optical fiber cable, the operation of the exemplary reel of FIG. 1 will be described in connection with such a use.

Figure 7:
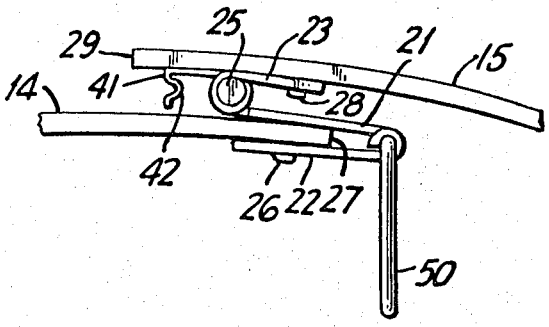
FIG. 7 is a front elevation of a portion of the reel of FIG. 1 when such reel is in its fully contracted configuration.

In order, in the installation of such cable, to simplify splicing operations and improve the quality of the cable splices, it has been the practice for the ends of a length of optical fiber cable to be connectorized. In underground plant, the cable must be somewhat longer than the pull length to assure sufficient cable to join the connectorized ends. Thus, there has been a need to provide means for neatly and compactly storing the excess cable in manholes out of harms way. That need is met by the FIG. 1 reel in a manner as follows:

Assume, that, to begin with, the reel is in its fully contracted configuration shown in FIG. 7, with retainer unit 70*b* being in the position shown in FIG. 1 in full line. As a first step, the reel is expanded to its FIG. 1 configuration by grasping the end portions 14 and 15 of the reel and then moving them angularly and radially with respect to each other until they reach their relative positions shown in FIG. 1. Such movement of those end portions is constrained by link 21 which pivots at each of pivotal connections 24, 25 to thereby itself move as end portions 14 and 15 move. As mentioned, link 21 is relatively stiff in that it is rigid or otherwise stiff enough to not be permanently deformed in its normal use, and to keep the pivot connections 24 and 25 equidistant or substantially so in the course of movement of the link between its FIG. 7 and FIG. 1 positions. As will be evident from FIGS. 7, 4 and 1, by virtue of those connections being so kept, and of their fixed coupling to end portions 14 and 15, either of the oppositely directed link movements between those positions will, in terms of angular and radial coordinates, be productive in the course of each such link movement of both angular and radial displacement between end portions 14 and 15.

Preferably (but not necessarily) the resilient band 10 is so constructed that the movement of link 21 from its FIG. 7 to its FIG. 1 position develops in the band 10 a resilient strain (or increase in resilient strain) causing the band to exert on the link a compressive resilient force.

With reel 9 being in its FIG. 1 position, the elements 14, 15, 21–25 are adapted, when in an appropriate geometry and in the presence of such force, to together serve as a link stabilizing means adapted of itself to maintain link 21 in its FIG. 1 position and hoop 13 thereby expanded. That is, the resilient force exerted by band 10 acts substantially in line with the lie in FIG. 1 of the link, and this being so and with enough friction being provided by the hinge connections 24, 25, the link 21 can, without more, be rendered stable in its FIG. 1 position. Moreover, such stability can be improved by, say, inserting a spacer (not shown) between end portion 14 and hinge plate 22 so that link 21 is tilted counterclockwise somewhat beyond its position shown in FIG. 1.

Stability of the link so obtained is, however, rather easily disrupted by inadvertently applied forces moving the hoop end portions to a relative positioning thereof at which link 21 would turn. Preferably, therefore, the mentioned link stabilizing means comprises (or also comprises) detent means cooperable with the link means to releasably hold link 21 in position by resilient force exerted by such detent means and other than the compressive resilient force provided by band 10. Such detent means takes the specific form in the FIG. 1 reel of the latch means constructed of latch finger 41 and aperture 40 in link 21. As the link moves towards its FIG. 1 position, the finger 41 enters the aperture such that, as the link attains that position, projection 42 of the finger makes detent engagement with the undersurface of the link. Because the link is so latched in position by projection 42 such that, after any play is taken up in the detent engagement, the breaking of such engagement by the pushing aside by the link of the projection is opposed by a positive yieldable force produced by the latch finger's resiliency, and such positive force requires a substantial amount of disturbing force to overcome it, link 21 will be stablized to remain in latched position despite the imposition on the reel of various extraneous forces resulting, for example, from dropping it, squeezing it or inadvertently hitting it.

Having brought the reel to its expanded configuration, any excess in a manhole of optical fiber cable is now wound by hand on the reel to form the coil represented in FIG. 1 by coil 60. As the coil is so being wound, the ears 72 of coil retainer units 70 prevent the coil from being inadvertently laterally displaced off the coil support surface 12 of the reel.

When all excess of the cable has been taken up by the coil, the reel is collapsed by manually activating the handle 50 to apply to the reel a collapsing force. That is, while the band 10 is held in one hand near end portion 15, handle 50 is pulled firmly inward by the other hand to subject latching finger 41 to an unlatching force sufficient to break the detent engagement of that finger with link 21 and, thereafter, to impart some counterclockwise pivotal movement to the link. Once the link has so become destabilized, the compressive resilient force exerted by band 10 on link 21 drives the link counterclockwise until the link reaches its position shown in FIG. 7 for which reel 9 has its fully contracted configuration. Termination of such movement is caused by the link 21 engaging the outer surface 12 of hoop end portion 14, which outer surface 12 accordingly provides a stop means for the link movement. Resilient band 10, however, continues to exert on the link a residue of resilient force which biases the link against end portion 14. As a result, link 21 is stably maintained in its FIG. 7 position, and the reel 9 will tend to remain fully contracted despite imposition thereon of various forces tending to more or less expand it.

As the reel is so contracted, its support surface 12 shrinks away from the coil 60 wound thereon. After full contraction of the reel has been achieved, a force is applied by hand to coil retainer unit **70*b* to break its detent engagement with latch finger 90 and, thereafter move that unit from (FIG. 1) its position shown in full line to its position shown in dot-dash line, the unit being thereupon retained in the latter position by its making of a detent engagement with latch finger 91. With the ears 72*b* of unit 70*b* thus being moved to no longer project radially outward of support surface 12 of the reel, the coil 60 can be, and is, easily removed therefrom by simply shifting the coil to permit it to clear the ears of the other retainer units 70*a*, 70*c* and then moving the coil laterally away from the reel. After the coil has been so removed, it is tied or taped for storage in the manhole. As a final step to complete the cycle of operation of the reel, coil retainer unit 70*b*** is returned to its original position.

If desired, one or both of the other coil retainer units **70*a* and 70*c* may be removably secured to band 10 as is unit 70*b* so as to be similarly pivotable between two positions at which the ears of the units do and do not, respectively, project radially outward of band 10, such other unit or units preferably being similarly retainable at each of such two positions by a latch finger or other detent means. While such modification may be convenient in certain applications, it is not necessary to permit removal of the coil from the reel provided that, in going from its FIG. 1 to its FIG. 7 configuration, the effective diameter of the reel is contracted enough in relation to the radial distance of projection of the ears 72 of units 70*a*, 70*c* beyond band 10 to permit the coil 60 to pass by those ears. The amount of appropriate contraction of that diameter in relation to that distance depends, to an extent, on the positioning of the fixed coil retainer units 70 around the reel. That is, if units were to each be located 180 degrees apart, and coil 60 in being removed were to remain circular, the decrease in such diameter would, in theory, have to be twice that distance. Inasmuch, however, as, in FIG. 1, the fixed units 70*a*, 70*c* are at 120 degrees from each other, the decrease in such diameter need not be as much. Also, it should be taken into account that the coil may be warpable into an elliptical shape as an aid in clearing the ears of the fixed units. In general, the shown arrangement of two fixed units 70*a*, 70*c* and one movable unit 70*b* disposed opposite discontinuity 16**, the three units being spaced from each other by 120 degree intervals, represents an optimum compromise in seeking to obtain concurrently the advantages of adequate retention of the coil on the reel, simplicity and economy in the providing of the units, and minimizing the contraction in effective diameter of the reel which is required in order for a coil wound thereon when fully expanded to pass by the units when the reel is fully contracted.

The contraction in the effective circumference provided by the use of link 21 is approximately twice the length of the link. In contrast, if the single link were to be replaced by a toggle joint, the contraction in such efffective circumference would be only about one-half the maximum possible spread of the toggle joint.

DETAILS OF CONSTRUCTION

For the purpose of winding optical fiber cable thereon, band 10 may be about two inches wide and one-eighth inch thick, hoop 13 having a diameter of about twenty inches, and the dimensions of other parts of the reel being to scale as shown in FIG. 1. Band 10 and the rivets used in the reel may be of aluminum, the remaining parts of the reel being made of steel. The reel may be so constructed that a ten to thirty pound pull on handle 50 will collapse the reel.

The above-described embodiment being exemplary only, additions thereto, omissions therefrom and modifications thereof may be made without departing from the spirit of the invention. For example, the annular means 13 can be made substantially wider than shown herein so that the loop resembles a drum. Further, annular means 13 can be constructed to exert resilient force placing link 21 in tension when in the FIG. 1 position, there being provided in that manner a link stabilizing means for maintaining the link in such position. When, thereafter moved to the FIG. 7 position, the link may be latched by appropriate detent means (not shown) so as to be releasably held in the latter position despite increase thereon of such tension force.

Evidently, the various latch means specifically disclosed herein as being used to latch link 21 and coil retainer **70*b*** can be replaced by other latch means which are different in their structure, in their mounting on the reel, or in their manner of cooperating with the latched part.

While, the exemplary reel described herein has been disclosed as being used for forming a coil of optical fiber cable which is thereafter removed from the reel and stored in a manhole, reels according to the invention can be used for winding thereon many other kinds of coilable elongated products as, for example but without restriction, electrical wire or electrical cable, fiber rope, line or thread, or even such a mundane item as garden house. Rather than winding a coilable elongated product thereon by holding the reel by hand and then rotating it, the reel in applications thereof may be removably mounted on a rotatable spider which is turned by a handle to wind the coil thereon, the reel with coil on it being thereafter removed from the spider.

Accordingly, the invention is not to be considered as limited save as is consonant with the scope of the following claims.

What is claimed is:

1. A collapsible reel for mounting thereon a coil of an elongated product, said reel comprising, a resilient band curved in a plane transverse to its width to form a discontinuous hoop and having first and second end portions separated by the discontinuity of said hoop, link means coupling said end portions together and comprising a relatively stiff link and first and second pivot connections therefor disposed at opposite ends thereof and each being fixedly coupled to said link and fixedly coupled to, respectively, said first and second end portions, said first pivot connection being disposed inside of, and adjacent to the termination of, said first end portion to be separated from said termination by a tab portion of said band, said link being pivotable in said plane at each of said connections to thereby be adapted to expand said hoop by a first pivoting movement of said link and to contract the effective circumference of said hoop by a second, oppositely directed, pivoting movement of said link, both of said link movements being productive in the course thereof of radial and angular displacement between said end portions of said hoop, and said link having a portion overlapping and registering with said tab portion on the inside thereof, and latch means for releasably coupling said overlapping portion and tab portion in substantially parallel alignment to provide by the portion of said link in non-overlapping relation with said tab portion an extension of said first end portion which is inserted into the circumference of said hoop to hold it expanded, such latch means being responsive to unlatching force to release said link from said tab portion so as to permit contraction of said hoop by said second pivoting movement of said link.

2. A reel according to claim 1 in which said link means comprises a "Z" hinge comprising, first and second plates fixedly secured to, respectively, said first and second end portions of said band, a center plate providing said rigid link, and first and second hinge pins pivotably connecting said center plate to, respectively, said first and second plates at, respectively, said first and second pivot connections.

3. A reel according to claim 2 in which said second end plate is secured to the second end portion of said band to project in part outward of the termination of said portion such that said second hinge pin is spaced around said hoop forward of said termination.

4. A reel according to claim 3 in which said second end plate is secured to said second end portion of said band on the inside thereof.

5. A reel according to any of claims 2, 3 or 4 further comprising a handle in the form of a bail having a crossarm disposed on the inside of said hoop, and having a pair of sidearms extending from said crossarm to the opposite ends of said second hinge pin and, further, being connected to said opposite ends.

6. A reel according to claim 1 further comprising at least one "U"-shaped coil retainer unit disposed along the length of said band and having a base on the inside of said band, and having also a pair of ears disposed at opposite ends of said base transversely outward of said band and projecting radially outward from said base, fastening means for securing said base to said band to permit selective movement of said unit between first and second positions at which said ears do and do not, respectively, project radially outward of the outer surface of said band, and means for holding said unit releasably in said first position.

7. A reel according to claim 6 in which said fastening means comprises hinge means connecting said base to the inside of said band, and in which said means for holding said unit comprises a resilient latch finger mounted on the inside of said band and adapted to make a detent engagement with said base.

8. A reel according to claim 1 in which said rigid link has an aperture formed therein, and said latch means comprises a resilient latch finger mounted on said tab portion on the inside thereof and adapted to enter said aperture and thereupon make a detent engagement with a portion of said link bounding said aperture.

* * * * *